US011406865B2

(12) United States Patent
Jin et al.

(10) Patent No.: US 11,406,865 B2
(45) Date of Patent: Aug. 9, 2022

(54) RUNNING DECK ASSEMBLY AND TREADMILL

(71) Applicants: BEIJING KINGSMITH TECHNOLOGY CO., LTD., Beijing (CN); BEIJING XIAOMI MOBILE SOFTWARE CO., LTD., Beijing (CN)

(72) Inventors: Guoqiang Jin, Beijing (CN); Xiaohui Zhang, Beijing (CN); Zhifeng Jing, Beijing (CN); Wei Wang, Beijing (CN); Chuangqi Li, Beijing (CN)

(73) Assignees: Beijing Kingsmith Technology Co., Ltd., Beijing (CN); Beijing Xiaomi Mobile Software Co., Ltd., Beijing (CN)

( * ) Notice: Subject to any disclaimer, the term of this patent is extended or adjusted under 35 U.S.C. 154(b) by 63 days.

(21) Appl. No.: 16/396,430

(22) Filed: Apr. 26, 2019

(65) Prior Publication Data

US 2019/0247708 A1 Aug. 15, 2019

Related U.S. Application Data

(63) Continuation of application No. PCT/CN2018/102039, filed on Aug. 23, 2018.

(30) Foreign Application Priority Data

Nov. 27, 2017 (CN) ..... 201711203566.4

(51) Int. Cl.
*A63B 22/02* (2006.01)

(52) U.S. Cl.
CPC ..... *A63B 22/0285* (2013.01); *A63B 22/0207* (2015.10); *A63B 22/0235* (2013.01); *A63B 2209/00* (2013.01); *A63B 2210/50* (2013.01)

(58) Field of Classification Search
CPC ..... A63B 21/4001; A63B 2210/50; A63B 2210/52; A63B 2210/54; A63B 2210/56;
(Continued)

(56) References Cited

U.S. PATENT DOCUMENTS 1,426,712 A * 8/1922 Chatfield ..... A63B 37/0003 473/355
4,505,476 A 3/1985 Rubin
(Continued)

FOREIGN PATENT DOCUMENTS

CN 1531451 A * 1/2002
CN 1531451 A 9/2004
(Continued)

OTHER PUBLICATIONS

Written Opinion of the International Searching Authority PCT, dated Nov. 2017 (Year: 2017).*
(Continued)

*Primary Examiner* — Megan Anderson
*Assistant Examiner* — Thao N Do
(74) *Attorney, Agent, or Firm* — Arch & Lake LLP

(57) ABSTRACT

A running deck assembly and a treadmill are provided. The running deck assembly includes: a front running deck; a rear running deck, wherein a front end face of the rear running deck abuts a rear end face of the front running deck; a flexible layer, laid on an upper surface of the front running deck and an upper surface of the rear running deck; and an annular running belt, rotatably mounted around the front running deck and the rear running deck with a clearance.

16 Claims, 13 Drawing Sheets

(58) Field of Classification Search
CPC ..... A63B 2210/58; A63B 2208/0204; A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0271; A63B 22/0278; A63B 22/0285; A63B 22/0292; A63B 22/04; A63B 22/06; A63B 22/0605; A47B 71/0036; A47B 13/08; A47B 13/088; A47B 13/10
USPC ..... 482/54, 4, 51
See application file for complete search history.

(56) References Cited

U.S. PATENT DOCUMENTS 4,757,987 A * 7/1988 Allemand ..... A63B 22/02 482/54
5,279,528 A * 1/1994 Dalebout ..... A63B 22/0023 482/54
5,314,180 A 5/1994 Yamagishi
5,330,392 A * 7/1994 Bresin ..... A63B 37/0002 473/130
5,533,951 A * 7/1996 Chang ..... A63B 22/02 198/841
5,542,892 A * 8/1996 Buhler ..... A63B 22/02 482/54
5,820,438 A 10/1998 Horton, III
5,976,061 A * 11/1999 Moon ..... A63B 22/0214 482/54
6,005,041 A * 12/1999 Cook ..... A63B 21/06 524/439
6,123,648 A * 9/2000 Stevens ..... A63B 22/02 482/54
6,186,208 B1 * 2/2001 McGilvery ..... B65B 35/50 156/566
6,290,610 B1 9/2001 Reid, Jr.
6,352,485 B1 3/2002 Philpot
6,454,683 B1 9/2002 Kaye
6,796,811 B1 9/2004 Pupkiewicz
7,780,578 B2 8/2010 Packham
10,589,147 B1 * 3/2020 Kostadis ..... A63B 22/025
2001/0018378 A1 8/2001 Burger
2002/0103039 A1 8/2002 Shmoldas
2002/0103057 A1 * 8/2002 Watterson ..... A63B 22/0023 482/54
2002/0151413 A1 * 10/2002 Dalebout ..... A63B 22/02 482/54
2005/0164836 A1 * 7/2005 Harker ..... A63B 22/205 482/52
2006/0142125 A1 * 6/2006 Pan ..... A63B 22/0023 482/54
2006/0205568 A1 * 9/2006 Huang ..... A63B 22/0207 482/54
2006/0272275 A1 * 12/2006 Riesmeier ..... B27G 11/00 52/745.19
2007/0020972 A1 1/2007 Shukla
2007/0087920 A1 * 4/2007 Dachraoui ..... A63B 21/0552 482/121
2008/0234111 A1 * 9/2008 Packham ..... A63B 22/02 482/54
2008/0280734 A1 * 11/2008 Dickie ..... A63B 22/0023 482/54
2009/0062072 A1 3/2009 Packham
2011/0152037 A1 * 6/2011 Wu ..... A63B 22/02 482/54
2013/0092096 A1 * 4/2013 Rosenberg ..... A01K 15/027 119/703
2013/0130869 A1 * 5/2013 Hou ..... A63B 22/0285 482/54
2015/0111673 A1 * 4/2015 Tomantschger ..... C09J 163/00 473/561
2015/0201748 A1 * 7/2015 Nivens ..... B43L 5/025 108/29
2015/0314184 A1 * 11/2015 Moya Saez ..... A63B 69/16 482/61
2016/0144224 A1 * 5/2016 Dalebout ..... A63B 22/0285 482/54
2016/0144225 A1 * 5/2016 Dalebout ..... A63B 22/02 482/54
2016/0211653 A1 * 7/2016 Linton ..... H01T 13/06
2017/0172331 A1 * 6/2017 Publicover ..... B32B 7/022
2017/0333748 A1 * 11/2017 Becker ..... A63B 22/0228
2018/0044934 A1 * 2/2018 Hall ..... E04H 4/0043
2018/0177290 A1 * 6/2018 Kim ..... A47B 3/083
2018/0345068 A1 * 12/2018 Beyer ..... A63B 22/0023
2018/0361194 A1 * 12/2018 Corbalis ..... A63B 22/0214
2020/0215380 A1 * 7/2020 Xing ..... A63B 22/0235

FOREIGN PATENT DOCUMENTS

CN 210409369 U * 5/2012
CN 202756886 U * 7/2012
CN 202756886 U 2/2013
CN 202756886 U * 2/2013
CN 204134121 U * 2/2014
CN 204134121 * 9/2014 ..... A63B 22/02
CN 204134121 U 2/2015
CN 104801012 A * 5/2015
CN 204393943 U 6/2015
CN 104801012 A 7/2015
CN 204522128 U 8/2015
CN 205019639 U 2/2016
CN 107349562 A 11/2017
CN 107349562 A * 11/2017
CN 107773913 A 3/2018
CN 107854807 A 3/2018
CN 207769064 U 8/2018
CN 207769065 U 8/2018
JP S54173588 U 12/1979
JP 3054892 U 12/1998
JP 3061053 U 9/1999
JP 2014147653 A 8/2014
KR 1020090058196 A 6/2009
KR 101281963 B1 7/2013
RU 256378902 9/2015
SU 1715374 2/1992

OTHER PUBLICATIONS

CN202756886-U_Translate (Year: 2013).*
CN 107349562 A_Translate (Year: 2015).*
CN1531451-A_Translate (Year: 2002).*
CN204134121-U_Translate (Year: 2014).*
English translation of the Written Opinion of the International Search Authority in the International Application No. PCT/CN2018/102039, dated Nov. 14, 2018, (4p).
First Office Action of the Korean Application No. 10-2019-7008471, dated Mar. 25, 2020, (12p).
First Office Action of the Japanese Application No. 2019-528767, dated Jun. 9, 2020, (8p).
International Search Report and Written Opinion issued in PCT/CN2018/102039, dated Nov. 14, 2018, 7 pages.
First Office Action and Search Report issued in CN201711203566.4, dated Apr. 29, 2019, 7 pages.
Chinese First Office Action (including English translation) issued in CN201711202678 8, dated Feb. 22, 2019, 13 pages.
Chinese Notification to Grant Patent (including English translation) issued in CN201711203566.4, dated Aug. 10, 2020, 3 pages.
Chinese Second Office Action (including English translation) issued in CN201711203566.4, dated Feb. 3, 2020, 8 pages.
Chinsese Second Office Action (including English tranlsation) issued in CN201711202678.8, dated Nov. 20, 2019, 13 pages.
Chinsese Third Office Action (including English tranlsation) issued in CN201711202678.8, dated Jul. 3, 2019, 14 pages.
International Search Report and Written Opinion issued in PCT/CN2018/102036, dated Nov. 16, 2018, 10 pages.
Japanese First Office Action (including English translation) issued in JP2019528761, dated Jun. 3, 2020, 9 pages.

(56) References Cited

OTHER PUBLICATIONS

Korean Final Rejection (including English translation) issued in KR20197008471 dated Sep. 2, 2020, 5 pages.
Korean Final Rejection (including English translation) issued in KR20197008475 dated Sep. 2, 2020, 4 pages.
Korean First Office Action (including English translation) issued in KR20197008475, dated Mar. 25, 2020, 14 pages.
Korean Written Opinion (including English translation) issued in KR20197008471 dated May 20, 2020, 15 pages.
Korean Written Opinion (including English translation) issued in KR20197008475 dated May 20, 2020, 14 pages.
Russian First Office Action (including English translation) issued in RU2020114613, dated Jul. 14, 2020, 10 pages.
Russian Notice of Allowance (including English translation) issued in RU2020114438, dated Jul. 28, 2020, 15 pages.
U.S. Non-Final Office Action issued in U.S. Appl. No. 16/396,445, dated Aug. 5, 2020, 46 pages.
Second Office Action of the Japanese application No. 2019-528767, dated Jan. 5, 2021, with English translation, (7p).
Advisory Action of the U.S. Appl. No. 16/396,445, dated Jan. 29, 2021, (10p).
Second Office Action of the Japanese Application No. 2019-528761, dated Mar. 5, 2021 with English translation, (7p).
First Office Action after RCE of the U.S. Appl. No. 16/396,445, dated Mar. 23, 2021, (56p).
Advisory Action of the U.S. Appl. No. 16/396,445, dated Dec. 10, 2021, (4 pages).
First Office Action after RCE of the U.S. Appl. No. 16/396,445, dated Jan. 18, 2022, (15 pages).

* cited by examiner

RUNNING DECK ASSEMBLY AND TREADMILL

CROSS-REFERENCE TO RELATED APPLICATION

The present application is based upon and claims the priority of PCT patent application No. PCT/CN2018/102039 filed on Aug. 23, 2018 which claims benefit of a Chinese Patent Application No. 201711203566.4, filed on Nov. 27, 2017, the contents of which are incorporated by reference herein in its entirety.

TECHNICAL FIELD

The present disclosure relates to the field of fitness equipment, and particularly to a running deck assembly and a treadmill.

BACKGROUND

A treadmill includes a running deck assembly, a driving assembly configured to drive the running deck assembly in operation, and a control assembly configured to control the driving assembly. The running deck assembly is generally placed on the ground and occupies a large area, and is difficult to store. In view of this, it is desirable to provide a foldable running deck assembly.

SUMMARY

The present disclosure provides a running deck assembly and a treadmill.

According to a first aspect of the present disclosure, a running deck assembly is provided, which includes:

- a front running deck;
- a rear running deck, wherein a front end face of the rear running deck abuts a rear end face of the front running deck;
- a flexible layer, laid on an upper surface of the front running deck and an upper surface of the rear running deck; and
- an annular running belt, rotatably mounted around the front running deck and the rear running deck with a clearance.

According to a second aspect of the present disclosure, a treadmill is provided, which includes a running deck assembly, wherein the running deck assembly includes:

- a front running deck;
- a rear running deck, wherein a front end face of the rear running deck abuts a rear end face of the front running deck;
- a flexible layer, laid on an upper surface of the front running deck and an upper surface of the rear running deck; and
- an annular running belt, rotatably mounted around the front running deck and the rear running deck with a clearance.

It is to be understood that both the foregoing general description and the following detailed description are exemplary only and are not restrictive of the present disclosure.

BRIEF DESCRIPTION OF DRAWINGS

For the purpose of illustrating the technical solutions provided by the examples of the present disclosure more definitely, the drawings used in the description of the examples will be presented briefly below. It is apparent that the drawings in the description below only show some examples of the present disclosure, and those skilled in the art may obtain other drawings according to these drawings without any creative work.

DETAILED DESCRIPTION

Figure 1A:
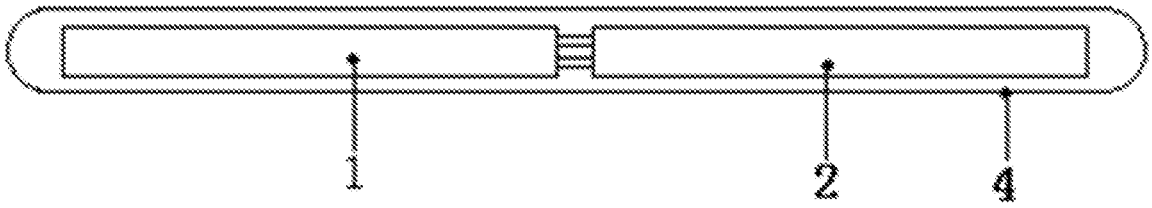
FIG. 1A is a front view of a running deck assembly, in an unfolded state, according to an example.

The aspects of the present disclosure are described in detail with the reference to the drawings.

Reference is made in detail to exemplary aspects, examples of which are illustrated in the accompanying drawings. The following description refers to the accompanying drawings in which the same numerals in different drawings represent the same or similar elements unless otherwise indicated. The implementations set forth in the following description of exemplary aspects do not represent all implementations consistent with the present disclosure. Instead, they are merely examples of apparatuses and methods consistent with aspects related to the present disclosure.

The terminology used in the present disclosure is for the purpose of describing particular examples only and is not intended to limit the present disclosure. As used in this disclosure and the appended claims, the singular forms "a", "an", and "the" are intended to include the plural forms as well, unless the context clearly indicates otherwise. It should also be understood that the term "and/or" as used herein refers to and includes any and all possible combinations of one or more of the associated listed items.

It should be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The term "flexible" that describes a property of a material may be used interchangeably with "soft" or "soft flexible". The term "transmission" may be used to refer to a motion of a running belt when it is driven.

It should be understood that the expression "the annular running belt 4 is rotatably mounted around the front running deck 1 and the rear running deck 2 with a clearance" mentioned in the examples of the present disclosure means: firstly, the front running deck 1 and the rear running deck 2 are accommodated within the annular running belt 4, and in an in-situ state without any external force, there is a gap between the annular running belt 4 and the front and the rear running decks 1, 2, which are not in direct contact; secondly, the annular running belt 4 may rotate around the front running deck 1 and the rear running deck 2, and be able to allow a transmission, i.e. the annular running belt 4 may roll around the front running deck 1 and the rear running deck 2. That is to say, the annular running belt 4 is mounted around the front running deck 1 and the rear running deck 2 with a clearance, and is able to roll around the front running deck 1 and the rear running deck 2. In addition, the annular running belt 4 may adaptively make contact with the front running deck 1 or the rear running deck 2 when the feet of the user step on the annular running belt 4.

Figure 2A:
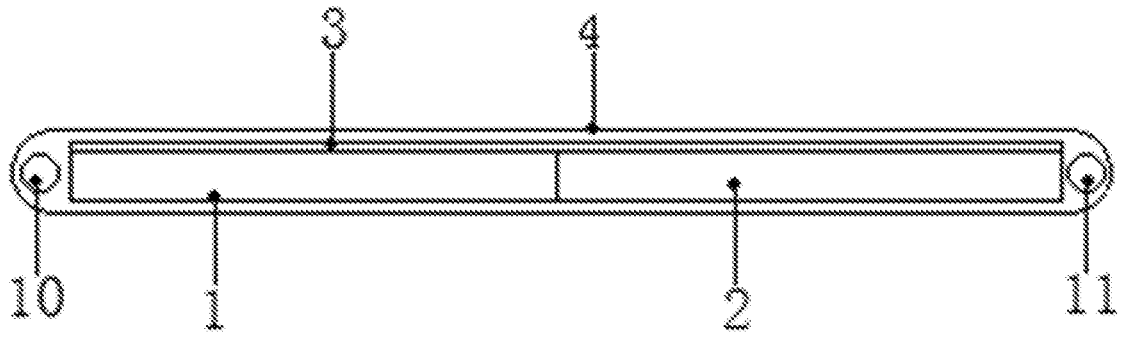
FIG. 2A is a front view of a running deck assembly according to an example.

The examples of the present disclosure provide a running deck assembly as shown in FIG. 2A, including:

a front running deck 1;

a rear running deck 2, in which a front end face of the rear running deck 2 abuts a rear end face of the front running deck 1;

a soft or flexible layer 3, laid on an upper surface of the front running deck and on an upper surface of the rear running deck; and an annular running belt 4, rotatably mounted around the front running deck 1 and the rear running deck 2 with a clearance.

Figure 1B:
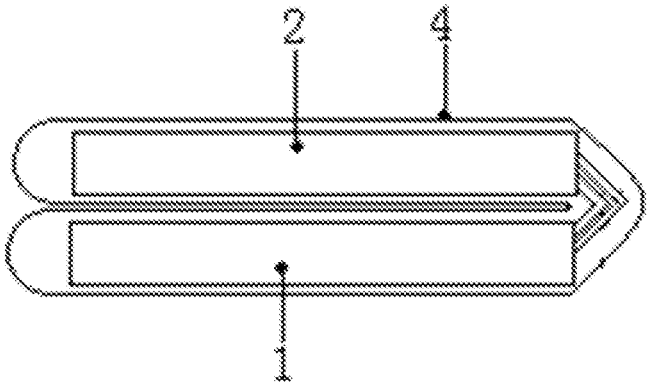
FIG. 1B is a front view of a running deck assembly, in a folded state, according to an example.

In an example, as shown in FIG. 1A, the running deck assembly includes: a front running deck 1; a rear running deck 2, having a front end face being hinged with a rear end face of the front running deck 1 by means of a hinge; and an annular running belt 4 mounted around the front running deck 1 and the rear running deck 2 with a clearance and being able to allow a transmission. There is a hinging gap at a location where the front running deck 1 is hinged to the rear running deck 2, such that the rear running deck 2 may be folded up onto the front running deck 1. In normal use, the front running deck 1 and the rear running deck 2 are unfolded and form an integral running deck, as shown in FIG. 1A; if it is necessary to fold the running decks, the rear running deck 2 may be folded up onto the front running deck 1 along the hinge, and a part of the annular running belt 4 facing the rear running deck 2 is also folded accordingly at the same time, as shown in FIG. 1B.

In the example, since the front running deck 1 of the foldable running deck assembly is hinged with the rear running deck 2, there is a hinging gap between the front running deck 1 and the rear running deck 2. The user may feel uncomfortable when doing exercise on the annular running belt 4 above the hinging gap. The examples of the present disclosure provide a running deck assembly, in which a soft layer 3 is laid on the upper surface of the front running deck 1 and the upper surface of the rear running deck 2, and the rear end face of the front running deck 1 abuts the front end face of the rear running deck 2. This arrangement not only may prevent the formation of a gap, for example the hinging gap, between the front running deck 1 and the rear running deck 2, but also does not affect the folding and unfolding of the front running deck 1 and the rear running deck 2 due to the flexibility property of the soft layer 3. This arrangement prevents the user from feeling discomfort on feet when doing exercise on the annular running belt 4 by avoiding a gap between the front running deck 1 and the rear running deck 2. Furthermore, the soft layer 3 may also reduce impact and vibration between the annular running belt 4 and the front and rear running decks 1, 2, thereby further improving the experience of the user when the user does exercise on the running deck assembly.

Moreover, even if there is a drop between the front running deck 1 and the rear running deck 2, it may be smoothed by laying the soft layer 3 on the front running deck and the rear running deck. As a result, running comfort for the user may be improved.

Figure 2B:
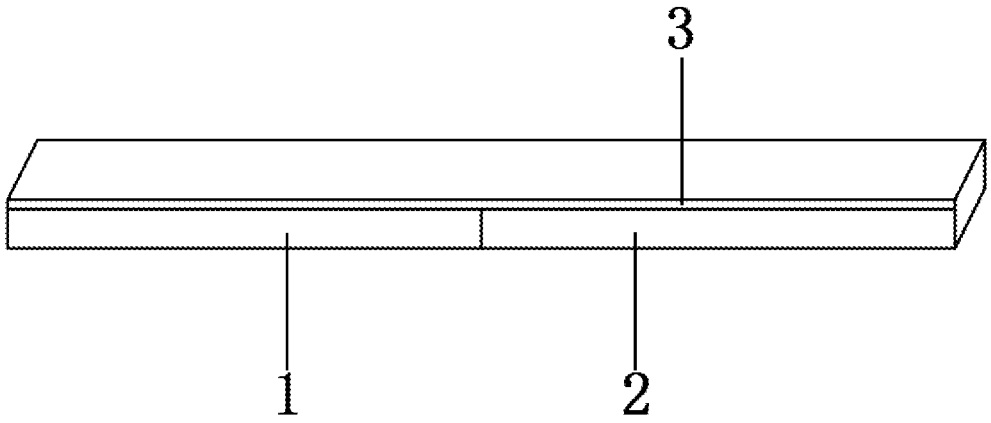
FIG. 2B is a schematic view of a front running deck and a rear running deck, in an unfolded flat state, according to another example.
Figure 2C:
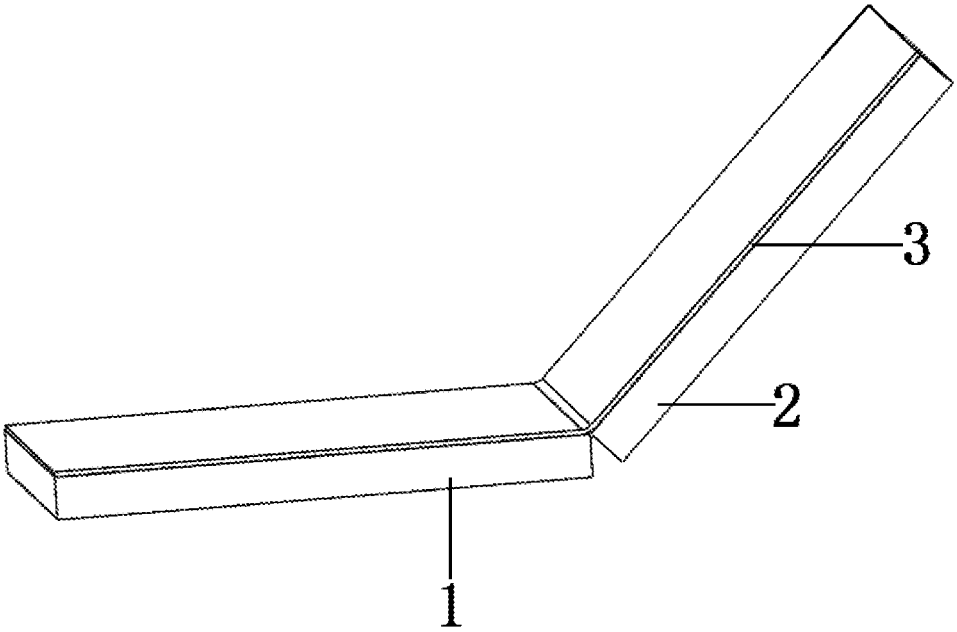
FIG. 2C is a schematic view of the front running deck and the rear running deck, in a folded state, according to still another example.

The rear running deck is foldable to the front running deck toward a direction of the flexible layer. It should be understood that in normal use of the running deck assembly according to the examples of the present disclosure, as shown in FIG. 2B, the front running deck 1 and the rear running deck 2 are unfolded and form an integral running deck. If it is necessary to fold the running decks, as shown in FIG. 2C, the rear running deck 2 may be folded up onto the front running deck 1 along the front end face of the rear running deck; meanwhile, a part of the annular running belt 4 and a part of the soft layer 3 facing the rear running deck 2 are also folded accordingly.

In an example, the soft layer 3 is laid on a part of or all of the upper surfaces of the front running deck 1 and the rear running deck 2. A laying area of the soft layer 3 is not specifically limited, as long as the soft layer 3 is laid on the upper surfaces of the front running deck 1 and the rear running deck 2 and the rear end face of the front running deck 1 abuts the front end face of the rear running deck 2 to allow the comfort exercise on the annular running belt 4.

In an example, the laying area of the soft layer 3 may be less than a sum of an upper surface area of the front running deck 1 and an upper surface area of the rear running deck 2.

In an example, the laying area of the soft layer 3 may be equal to a sum of the upper surface area of the front running deck 1 and the upper surface area of the rear running deck 2.

In an example, the laying area of the soft layer 3 may be larger than a sum of the upper surface area of the front running deck 1 and the upper surface area of the rear running deck 2 while the soft layer 3 does not affect the folding, unfolding and use of the running deck assembly according to the examples of the present disclosure.

The soft layer 3 may be laid on the upper surface of the front running deck 1 and the upper surface of the rear running deck 2 in various ways. The following exemplary description is given with easy setting and high connecting strength.

In an example, the soft layer 3 is laid on the upper surface of the front running deck 1 and on the upper surface of the rear running deck 2 by adhering. The adherence is a method that facilitates firm connections between the soft layer 3 and the front and rear running decks 1, 2 which are made of different materials, and that is simple to perform.

In an example, the soft layer 3 may be adhered on the upper surface of the front running deck 1 and on the upper surface of the rear running deck 2 by means of super glue, such as 3M super glue.

For the purpose of improving an adhesion between the soft layer 3 and the front and rear running decks 1, 2, a rough structure may be provided on an adhesive face of the front running deck 1 and an adhesive face of the rear running deck 2, to improve an adhesive strength between the adhesive faces and the super glue layer. The rough structure may be a groove for receiving the super glue, which may have a circular, rectangular, or triangular structure, or other regular or irregular structures, such that more super glue is received between the soft layer 3 and the front and rear running decks 1, 2, and thus the connecting strength between the soft layer 3 and the front and rear running decks 1, 2 is reinforced.

In an example, the soft layer 3 may also be fixed on the upper surface of the front running deck 1 and on the upper surface of the rear running deck 2 by means of fastening tapes. The fastening tapes can not only ensure a firm connection between the soft layer 3 and the front and rear running decks 1, 2, but also facilitate the assembly or disassembly between the soft layer 3 and the front and rear running decks 1, 2.

The fastening tapes may be Velcro tapes, including nylon hook tapes and nylon loop tapes. For example, the nylon hook tape may be provided on a lower surface of the soft layer 3, and the nylon loop tape may be provided on the upper surface of the front running deck 1 and the upper surface of the rear running deck 2, such that the soft layer 3 may be laid on the upper surface of the front running deck 1 and on the upper surface of the rear running deck 2 by engagement of the nylon hook tapes and the nylon loop tapes.

In another example, the soft layer 3 may be laid on the upper surface of the front running deck 1 and on the upper surface of the rear running deck 2 by snap-fitting. The snap-fitting manner can not only ensure a firm connection between the soft layer 3 and the front and rear running decks 1, 2, but also facilitate the assembly or disassembly between the soft layer 3 and the front and rear running decks 1, 2.

In an example, the lower surface of the soft layer 3 may be provided with multiple male or female members, and the upper surface of the front running deck 1 and the upper surface of the rear running deck 2 may be provided with multiple female or male members, then the connection between the soft layer 3 and the front and rear running decks 1, 2 may be implemented by the adaptive engagement of the male members with the female members. When disassembly is required, one just needs to lift the soft layer 3 upwards.

Alternatively, the lower surface of the soft layer 3 may be provided with multiple fixture blocks, and the upper surfaces of the front running deck 1 and the rear running deck 2 may be provided with multiple fixture grooves adapted to the fixture blocks, then the connection between the soft layer 3 and the front and rear running decks 1, 2 may be implemented by the adaptive engagement of the fixture blocks with the fixture grooves. When disassembly is required, one just needs to lift the soft layer 3 upwards.

A thickness of the soft layer 3 may be chosen according to specific applications. In an example, the thickness of the soft layer 3 may be between 0.8 mm and 1.2 mm, for example 0.8 mm, 0.9 mm, 1.0 mm, 1.1 mm, 1.2 mm, etc. The thickness of the soft layer 3 is chosen in such a way that the comfort of the user during running may be improved while a poor touch experienced by the feet of the user due to an excessively soft layer 3 may be avoided.

The soft layer 3 may be made of various materials with excellent softness and plasticity. In an example, the soft layer 3 may be made of ethylene-vinyl acetate copolymer or polyethylene.

The use of ethylene-vinyl acetate copolymer (EVA) provides the soft layer 3 with excellent properties in terms of water resistance, corrosion resistance, plasticity, processability, anti-vibration and sound insulation or the like. The use of polyethylene (PE) provides the soft layer 3 with excellent properties in terms of water resistance, corrosion resistance and plasticity or the like. Further, EVA and PE have a low cost and are easy to obtain.

In the running deck assembly according to the examples of the present disclosure, a soft layer is laid on the upper surface of the front running deck and the upper surface of the rear running deck, and the rear end face of the front running deck abuts the front end face of the rear running deck. This arrangement not only may prevent the formation of a gap between the front running deck and the rear running deck, but also does not affect the folding and unfolding of the front running deck and the rear running deck due to the flexibility property of the soft layer. This arrangement prevents the user from feeling discomfort on feet when doing exercise on the annular running belt by avoiding the gap between the front running deck and the rear running deck. Furthermore, the soft layer may also reduce impact and vibration between the annular running belt and the front and rear running decks, thereby further improving the experience of the user when the user does exercise on the running deck assembly.

Although the folding and unfolding of the front running deck 1 and the rear running deck 2 can be performed with the soft layer 3 laid on the upper surface of the front running deck 1 and on the upper surface of the rear running deck 2, it is not easy for the front running deck 1 and the rear running deck 2 to be flatly spread out (i.e. an angle between the front running deck 1 and the rear running deck 2 may be sometimes less than 180°) due to the flexibility property of the soft layer 3. This will affect the comfort of the user when doing exercise on the annular running belt 4. In view of this, in an example as shown in FIG. 2D, the running deck assembly according to the examples of the present disclosure further includes a detachable spreading component 5, configured to keep the front running deck 1 and the rear running deck 2 flatly spread out or lying flat.

The spreading component 5 may be arranged in various ways. The following exemplary description is given with an easy setting and a good unfolding effect (or a good flat spreading effect) of the front running deck 1 and the rear running deck 2.

Figure 2D:
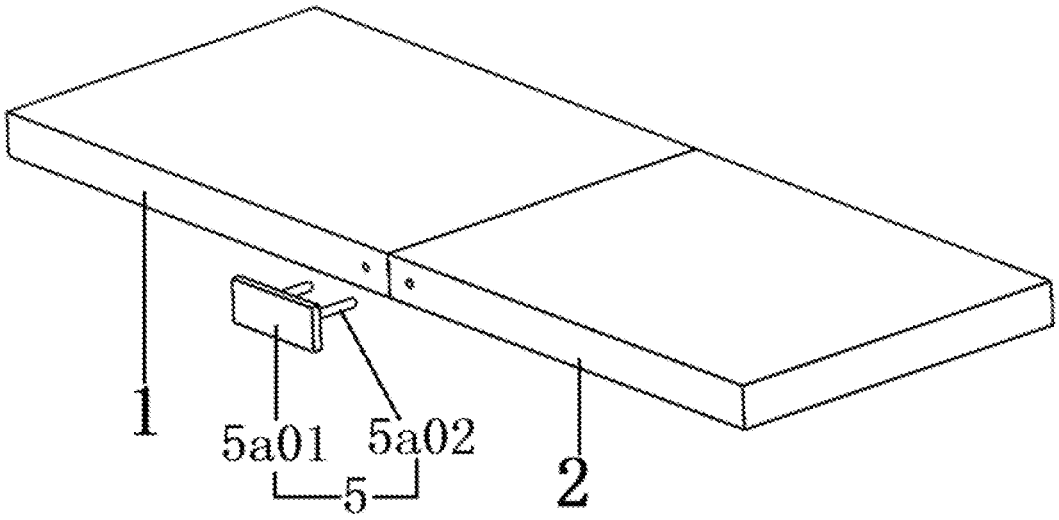
FIG. 2D is a schematic view of a spreading component, with a first structure and being detached from the front running deck and the rear running deck, in the running deck assembly according to yet another example.
Figure 2E:
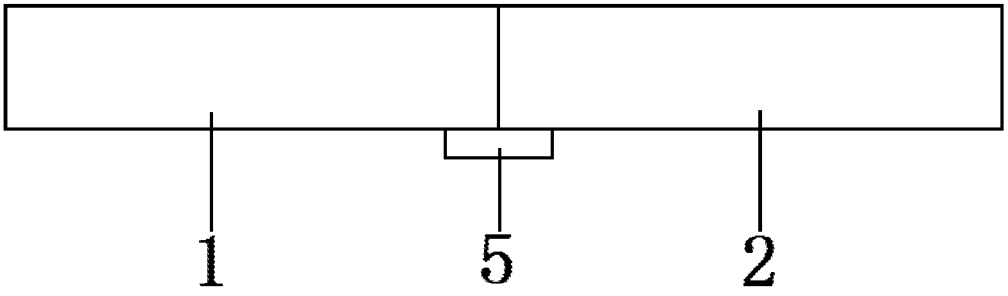
FIG. 2E is a top view of the spreading component, with the first structure and being connected to the front running deck and the rear running deck, in the running deck assembly according to a further example.

In an example, as shown in FIG. 2D, the spreading component 5 includes: a first spreading board **5*a*01 and at least two connecting bars 5*a*02 provided on the first spreading board 5*a*01. The at least two connecting bars 5*a*02 are detachably connected to a lateral face of the front running deck 1 and a lateral face of the rear running deck 2 respectively. The first spreading board 5*a*01 abuts the lateral face of the front running deck 1 and the lateral face of the rear running deck 2, as shown in FIG. 2**E.

In an example, the spreading component 5 includes: a first spreading board **5*a*01 and at least two connecting bars 5*a*02 provided on the first spreading board 5*a*01. The at least two connecting bars 5*a*02 are detachably connected to a lower surface of the front running deck 1 and a lower surface of the rear running deck 2 respectively. The first spreading board 5*a*01 abuts the lower surface of the front running deck 1 and the lower surface of the rear running deck 2**.

It should be understood that both the front running deck 1 and the rear running deck 2 are in a structure of rectangular board. The spreading component 5 is arranged as the structure abovementioned, such that a relative position between the front running deck 1 and the rear running deck 2 is kept fixed after the at least two connecting bars **5*a*02 are connected to the front running deck 1 and the rear running deck 2, and the front running deck and the rear running deck are kept flatly spread out. In addition, due to the abutment of the first spreading board 5*a*01 to the lateral faces or the lower faces of the front running deck 1 and the rear running deck 2, the relative position between the front running deck 1 and the rear running deck 2 is rectified to further ensure that the front running deck 1 and the rear running deck 2 are flatly spread out or lying flat. When the folding of the running decks is required, the spreading component 5** may be removed to allow the folding.

In the above two possible examples, the detachable connection between the spreading component 5 and the front running deck 1 and the rear running deck 2 may be performed in various ways, the exemplary description of which is given below.

In an example, the spreading component 5 may be connected to the lateral faces or the lower surfaces of the front running deck 1 and the rear running deck 2 by snap-fitting connection. The snap-fitting connection is easy to arrange and facilitates the detachment or assembly between the spreading component 5 and the front and the rear running decks 1, 2.

As shown in FIG. 2D, if the number of the connecting bars **5*a*02 is two, the lateral faces or the lower surfaces of the front running deck 1 and the rear running deck 2 are provided with two connection holes adapted to these two connecting bars 5*a*02. When the spreading component 5 is connected to the lateral faces of the front running deck 1 and the rear running deck 2 by snap-fitting, the snap-fitting connection of the spreading component 5 to the lateral faces of the front running deck 1 and the rear running deck 2 is performed by snapping the two connecting bars 5*a*02 into the two connection holes. In addition, when the spreading component 5 is connected to the lower surfaces of the front running deck 1 and the rear running deck 2 by snap-fitting, the snap-fitting connection of the spreading component 5 to the lower surfaces of the front running deck 1 and the rear running deck 2 is performed by snapping the two connecting bars 5*a*02 into the two connection holes. When the detachment of the spreading component 5 is required, the two connecting bars 5*a*02** are pulled out from the two connection holes to allow the detachment.

The connecting bars **5*a*02** may be fixed in the connection holes by friction forces.

In an example, the spreading component 5 may be connected to the lateral faces or the lower surfaces of the front running deck 1 and the rear running deck 2 by threaded connection. The threaded connection is easy to arrange and facilitates the detachment or assembly between the spreading component 5 and the front and the rear running decks 1, 2.

The first spreading board **5*a*01 may be provided with two through holes, and each of the lateral faces or the lower surfaces of the front running deck 1 and the rear running deck 2 may be provided with one internal threaded hole. When the spreading component 5 is connected to the lateral faces of the front running deck 1 and the rear running deck 2, the two connecting bars 5*a*02 (which may be bolts, for example) pass through the two through holes in the first spreading board 5*a*01, and are screwed into the two internal threaded holes in the lateral faces of the front running deck 1 and the rear running deck 2. When the spreading component 5 is connected to the lower surfaces of the front running deck 1 and the rear running deck 2, the two connecting bars 5*a*02 pass through the two through holes in the first spreading board 5*a*01, and are screwed into the two internal threaded holes in the lower surfaces of the front running deck 1 and the rear running deck 2. The detachment of the spreading component 5 from the front running deck 1 and the rear running deck 2 may be performed by detaching the two connecting bars 5*a*02** from the two internal threaded holes.

Figure 2F:
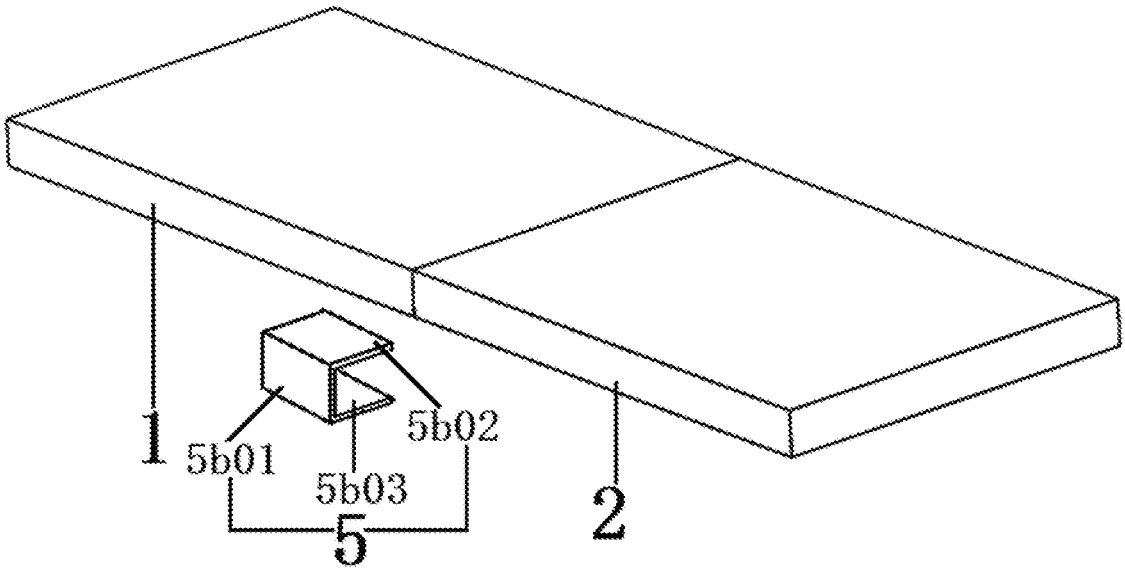
FIG. 2F is a schematic view of a spreading component, with a second structure and being detached from the front running deck and the rear running deck, in the running deck assembly according to a further example.

In an example, as shown in FIG. 2F, the spreading component 5 includes: a second spreading board **5*b*01, and an upper clamping board 5*b*02 and a lower clamping board 5*b*03 perpendicularly connected with a face of the second spreading board 5*b*01 on a same side of the second spreading board. The upper clamping board 5*b*02 and the lower clamping board 5*b*03 may be clamped on the upper surfaces and the lower surfaces of the front running deck 1 and the rear running deck 2 at the abutment faces of the front running deck and the rear running deck respectively, such that the relative position between the front running deck 1 and the rear running deck 2 is kept unchanged, and the flat spreading of the front running deck 1 and the rear running deck 2 is achieved. This structure of the spreading component 5 is simple and easy to arrange, and facilitates the detachment and assembly, and thus a flat spreading effect of running deck 1 and the rear running deck 2** may be achieved.

For facilitating the detachment and assembly of the spreading component 5, the upper clamping board **5*b*02 may be made of elastic rubber material, in order to impart elasticity property to the upper clamping board 5*b*02**.

Figure 2G:
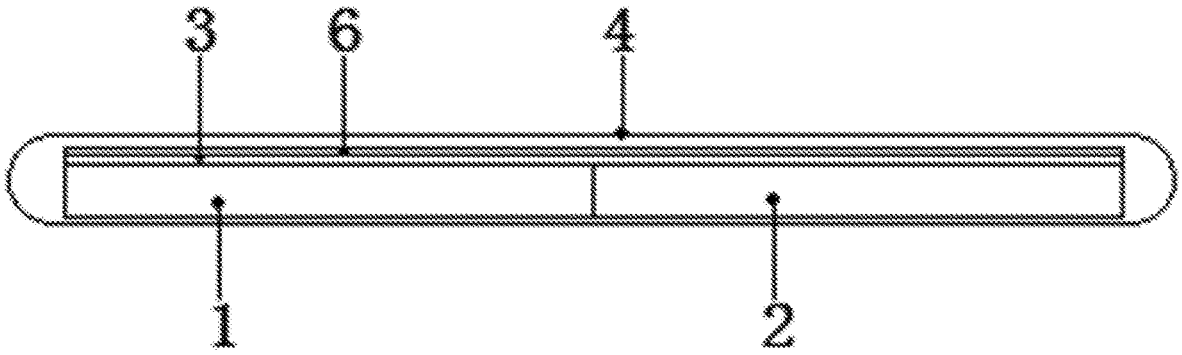
FIG. 2G is a front view of a running deck assembly provided with a wear-resisting layer according to a further example.

In order to prevent the annular running belt 4 from wearing the soft layer 3 during transmission, in an example, as shown in FIG. 2G, the running deck assembly according to the examples of the present disclosure further includes a wear-resisting layer 6. The wear-resisting layer 6 is laid on an upper surface of the soft layer 3.

It should be understood that the wear-resisting layer 6 should have good plasticity, and should not affect the folding and unfolding of the running deck assembly according to the examples of the present disclosure.

The wear-resisting layer 6 may be laid on the upper surface of the soft layer 3 in various ways. The following exemplary description is given with an easy setting and high connecting strength.

In an example, the wear-resisting layer 6 is laid on the upper surface of the soft layer 3 by adhering. The adhering facilitates the firm connection between the soft layer 3 and the wear-resisting layer 6 made of different materials and is simple to perform.

In an example, the wear-resisting layer 6 may be adhered on the upper surface of the soft layer 3 by super glue.

In an example, the wear-resisting layer 6 may be fixed on the upper surface of the soft layer 3 by fastening tapes.

The arrangement for the super glue or the fastening tapes may refer to the above description regarding the soft layer 3, and will not be described here.

In another example, the wear-resisting layer 6 may be laid on the upper surface of the soft layer 3 by snap-fitting. The manner of snap-fitting not only makes sure of a firm connection between the wear-resisting layer 6 and the soft layer 3, but also facilitates the assembly or disassembly between the wear-resisting layer 6 and the soft layer 3.

In an example, a lower surface of the wear-resisting layer 6 may be provided with multiple male or female members, and the upper surface of the soft layer 3 may be provided with multiple female or male members, then the connection between the soft layer 3 and the wear-resisting layer 6 may be implemented by the adaptive snapping of the male members with the female members. When a disassembly is required, one just needs to lift the wear-resisting layer 6 upwards.

In an example, the lower surface of the wear-resisting layer 6 may be provided with multiple fixture blocks, and the upper surface of the soft layer 3 may be provided with multiple fixture grooves adapted to the fixture blocks, then the connection between the wear-resisting layer 6 and the soft layer 3 may be implemented by the adaptive engagement of the fixture blocks with the fixture grooves. When a disassembly is required, one just needs to lift the wear-resisting layer 6 upwards.

A thickness of the wear-resisting layer 6 may be chosen according to specific applications. In an example, the thickness of the wear-resisting layer 6 may be between 0.3 mm and 0.5 mm, for example 0.3 mm, 0.4 mm, or 0.5 mm, etc. The thickness of the wear-resisting layer 6 is chosen in such a way that the thickness of the wear-resisting layer may adapt to the thickness of the soft layer 3, may prevent the wear of the soft layer 3, and may provide the user with a good touch for the feet and a comfortable running experience.

The wear-resisting layer 6 may be made of various materials with wear-resistance, plasticity or the like. In an example, the wear-resisting layer 6 may be made of poly tetra fluoroethylene, polyamide, or polyethylene terephthalate.

The wear-resisting layer 6 of poly tetra fluoroethylene (PTFE) provides the wear-resisting layer 6 with excellent properties in terms of corrosion resistance, lubrication and non-stickiness, electrical insulation, high temperature resistance and wear resistance or the like. The poly tetra fluoroethylene is also called Teflon.

The wear-resisting layer 6 of polyamide (PA) provides the wear-resisting layer 6 with excellent properties in terms of tensile strength, impact strength, rigidity, wear resistance and chemical resistance or the like. The polyamide is also called polyamide fiber.

The wear-resisting layer 6 of polyethylene terephthalate (PET) provides the wear-resisting layer 6 with excellent properties in terms of creep resistance, fatigue resistance, abrasion resistance and dimensional stability or the like. Further, PTFE, PA and PET have a low cost and are easy to obtain.

Figure 2H:
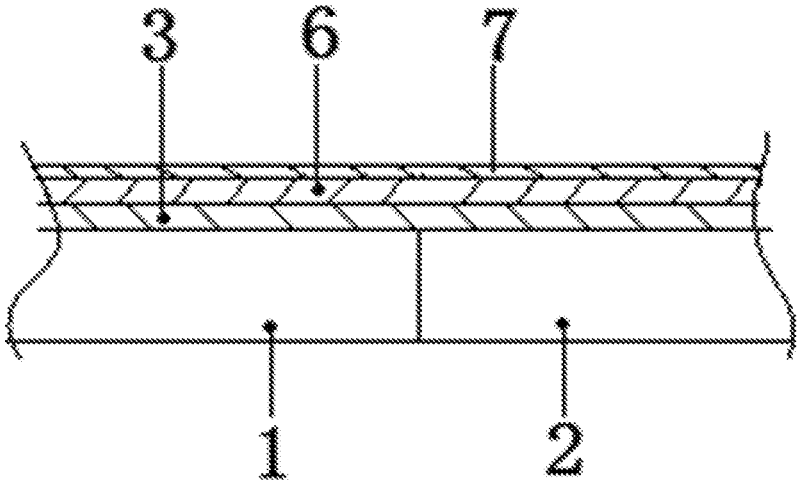
FIG. 2H is a partial enlarged view of the running deck assembly shown in FIG. 2G.

In order to prevent the noise resulting from the sliding friction between the wear-resisting layer 6 and the annular running belt 4, and to ensure a more smooth transmission of the annular running belt 4, the running deck assembly according to the examples of the present disclosure further includes a smooth layer 7, which is laid on the upper surface of the wear-resisting layer 6, as shown in FIG. 2H.

It should be understood that a friction coefficient of the smooth layer 7 should adapt to that of the annular running belt 4. This arrangement may not only prevent the noise resulting from the sliding friction between the wear-resisting layer 6 and the annular running belt 4, but also ensure a more smooth transmission of the annular running belt 4. Moreover, slipping phenomenon may be avoided when the user is exercising on the annular running belt 4.

The smooth layer 7 may be laid on the upper surface of the wear-resisting layer 6 in various ways. The following exemplary description is given with easy setting and high connecting strength.

In an example, the smooth layer 7 is laid on the wear-resisting layer 6 by adhering. The adhering facilitates the firm connection between the smooth layer 7 and the wear-resisting layer 6 made of different materials and is simple to perform. The specific arrangement for the smooth layer may refer to the description regarding the soft layer 3.

In another example, the smooth layer 7 may be laid on the upper surface of the wear-resisting layer 6 by spraying. The spraying facilitates the firm connection between the smooth layer 7 and the wear-resisting layer 6 made of different materials and is simple to perform.

The smooth layer 7 may be made of various materials with a friction coefficient less than that of the wear-resisting layer 6. In an example, the smooth layer 7 is made of a rubber material doped with graphite. Such material of the smooth layer 7 may not only provide the smooth layer 7 with a relatively low friction coefficient, but also provide a good touch for the feet of the user during running.

Figure 2I:
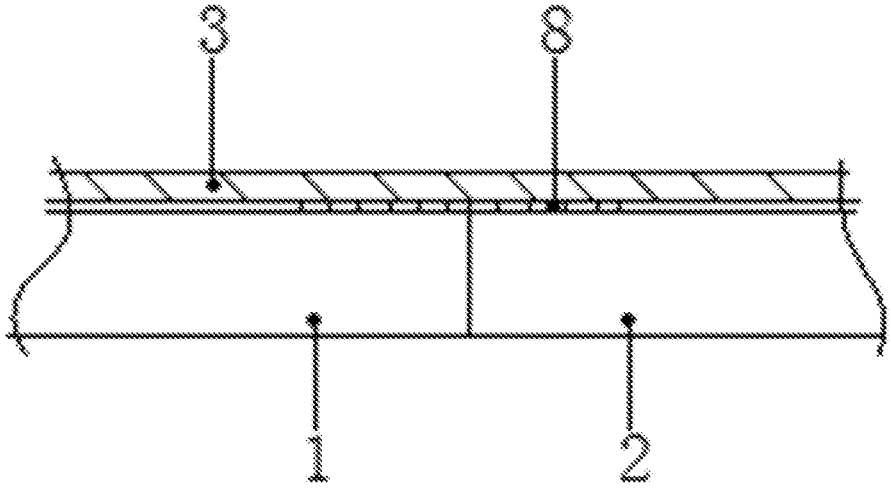
FIG. 2I is a partial enlarged view of the running deck assembly shown in FIG. 2A.

In an example, when the running deck assembly according to the examples of the present disclosure is folded or unfolded, in order to prevent a bump caused by the separation of parts of the soft layer 3 on two sides of the abutment faces of the front and rear running decks 1, 2 from the front running deck 1 or from the rear running deck 2, the running deck assembly according to the examples of the present disclosure further includes first fasteners 8, which are configured to fasten, on two sides of the abutment faces of the front and rear running decks 1, 2, the connection between the soft layer 3 and the front and rear running decks 1, 2, as shown in FIG. 2I.

The first fastener 8 can be arranged in various forms, and some examples, in which the first fastener 8 is easy to arrange, are given below.

In an example, the first fasteners 8 are super glue layers, which are adhered, on two sides of the abutment faces of the front running deck 1 and the rear running deck 2, between the soft layer 3 and the front running deck 1 and between the soft layer 3 and the rear running deck 2, see FIG. 2I.

The super glue layers may be 3M super glue layers.

It should be understood that if the soft layer 3 is laid on the upper surface of the front running deck 1 and the upper surface of the rear running deck 2 by adhering, the first fastener 8 may be super glue layers with a larger thickness.

For the purpose of further improving the connecting strength between the soft layer 3 on two sides of the abutment faces of the front and rear running decks 1, 2 and the front and rear running decks 1, 2, a lower surface of the soft layer 3 and the upper surfaces of the front running deck 1 and the rear running deck 2 may be provided with a rough structure. With this arrangement, when the super glue layers are adhered between the soft layer and the front and rear running decks, they may form first fasteners 8 with a higher connecting strength.

When the first fasteners 8 are in the form of super glue layers, the dimension of the super glue layers may be determined depending on specific applications. In an example, a total length of the super glue layers in a front-rear direction is between 1 and 2 cm, for example, 1 cm, 1.2 cm, 1.4 cm, 1.6 cm, 1.8 cm, or 2 cm, etc.; the thickness of the super glue layer is between 0.1 and 0.2 mm, for example may be 0.1 mm, 0.12 mm, 0.14 mm, 0.16 mm, 0.18 mm, or 0.2 mm, etc.

With this dimension arrangement of the first fasteners 8, the connecting strength between the soft layer 3 on two sides of the abutment faces of the front and rear running decks 1, 2 and the front and rear running decks 1, 2 may be increased, such that a separation of the soft layer 3 from the front running deck 1 or from the rear running deck 2 may be prevented when the running deck assembly according to the examples of the present disclosure is folded or unfolded.

In an example, the first fasteners 8 are rivets, which rivet the soft layer 3 to the front running deck 1 and rivet the soft layer 3 to the rear running deck 2, on two sides of the abutment faces of the front and rear running decks 1, 2. The riveting not only ensures the firm connection between the soft layer 3 and the front running deck 1 and between the soft layer 3 and the rear running deck 2, but also is convenient to operate, assemble and disassemble.

The rivets may be flexible rivets, or may be non-flexible rivets. For example, in the case of flexible rivets, the flexible rivets can be made of the same material as that of the soft layer 3, so as to prevent the user from feeling discomfort when doing exercise on the annular running belt 4.

In the case of non-flexible rivets, the soft layer 3 may be provided with counter bores, to avoid an influence on the comfort for the user when running. After the rivets are riveted to the front running deck 1 or the rear running deck 2 by passing through the counter bores, the heads of the rivets are sunk below the surface of the soft layer 3.

In an example, the first fasteners 8 are flexible binding components, which bind, on two sides of the abutment faces of the front and rear running decks 1, 2, the soft layer 3 with the front running deck 1, and bind the soft layer 3 with the rear running deck 2. By means of the flexible binding components, the soft layer 3 may be banded with the front running deck 1 and banded with the rear running deck 2 in a convenient manner. Moreover, the flexible binding components are flexible and do not affect the comfort of the user when doing exercise on the annular running belt 4.

The flexible binding components may be flexible binding strips or flexible binding hoops. For example, in the case of the flexible binding strips, the flexible binding strips may be wound on the soft layer 3 on two sides of the abutment faces of the front and rear running decks 1, 2 and the front running deck 1, and wound on the soft layer 3 and the rear running deck 2, to allow a firm connection between the soft layer 3 and the front and the rear running decks 1, 2.

In the case of flexible binding hoops, the flexible binding hoops may be mounted around the soft layer 3 and the front running deck 1, and mounted around the soft layer 3 and the rear running deck 2, to allow a firm connection between the soft layer 3 and the front and the rear running decks 1, 2.

Figure 2J:
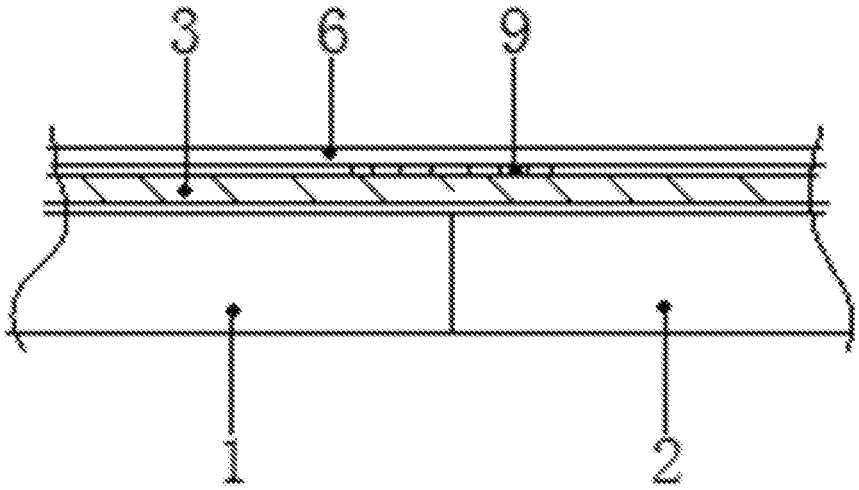
FIG. 2J is another partial enlarged view of the running deck assembly shown in FIG. 2G.
Figure 3:
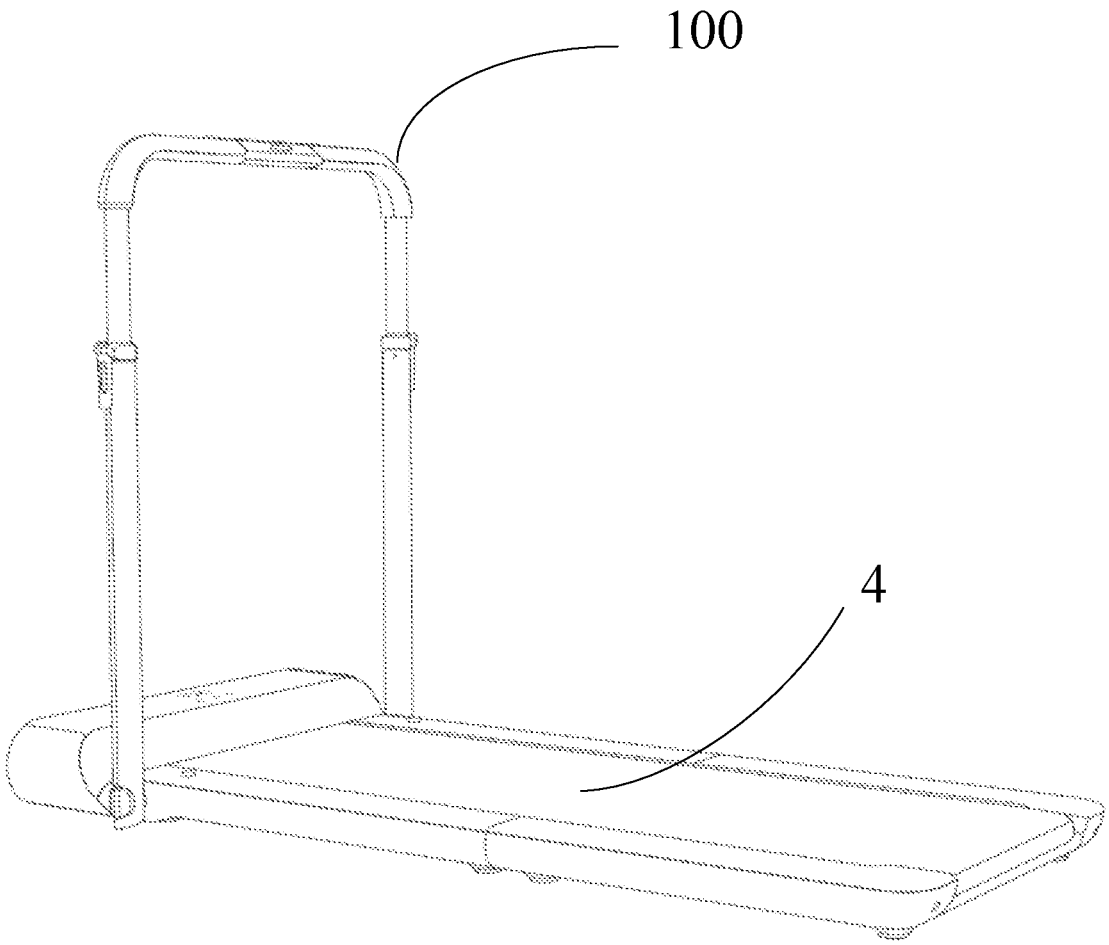
FIG. 3 is a side view of a treadmill, according to an example.

Further, in an example, when the running deck assembly according to the examples of the present disclosure is folded or unfolded, in order to prevent a bump caused by the separation of parts of the soft layer 3 on two sides of the abutment faces of the front and rear running decks 1, 2 from the wear-resisting layer 6, the running deck assembly according to the examples of the present disclosure further includes a second fastener 9 which is configured to fasten, on two sides of the abutment faces of the front and rear running decks 1, 2, the connection between the soft layer 3 and the wear-resisting layer 6, as shown in FIG. 2J.

The second fastener 9 can be arranged in various forms similar to the first fastener 8. On the premise of ease in arrangement, the second fastener 9 may be a super glue layer, see FIG. 2J.

It should be understood that if the wear-resisting layer 6 is laid on the soft layer 3 by adhering, the second fastener 9 may be a super glue layer with a larger thickness. In this case, the specific arrangement of the second fastener 9 may refer to that of the first fastener 8, and will not be described here.

The dimension of the second fastener 9 may be determined depending on specific applications. In an example, a length of each second fastener 9 in a front-rear direction is between 1 and 2 cm, for example, 1 cm, 1.2 cm, 1.4 cm, 1.6 cm, 1.8 cm, or 2 cm, etc. The thickness of each second fastener is between 0.1 and 0.2 mm, for example may be 0.1 mm, 0.12 mm, 0.14 mm, 0.16 mm, 0.18 mm, or 0.2 mm, etc. With this dimension arrangement of the second fastener 9, the connecting strength between the soft layer 3 and the wear-resisting layer 6 may be increased, and the dimension of the second fastener may match that of the soft layer 3 and that of the wear-resisting layer 6.

As shown in FIG. 2A, the running deck assembly according to the examples of the present disclosure further includes: a front roller 10, a rear roller 11, and a support (not shown). The support is configured to support the front running deck 1, the rear running deck 2, the front roller 10, and the rear roller 11. The front roller 10 is rotatably arranged in front of the front running deck 1, and the rear roller 11 is rotatably arranged at rear of the rear running deck 2. The annular running belt 4 is mounted around the front roller 10 and the rear roller 11 to allow the transmission around them. Meanwhile, the front running deck 1 and the rear running deck 2 are accommodated within the annular running belt, thus the annular running belt is mounted around the front running deck 1 and on the rear running deck 2 with a gap and is able to allow the transmission.

Diameter of each of the front roller 10 and the rear roller 11 is larger than a thickness of each of the front running deck 1 and the rear running deck 2. In a default state, there is a gap between the annular running belt 4 and the front and the rear running decks 1, 2, i.e. the annular running belt 4 is not completely in contact with the front running deck 1 and the rear running deck 2. During the exercise, a driving assembly drives the front roller 10, and the rear roller 11 is driven due to the transmission of the annular running belt 4. It should be understood that the annular running belt 4 is in direct contact with the wear-resisting layer 6 provided on the front running deck 1 and the rear running deck 2 when the feet of the user step on the annular running belt 4.

The examples of the present disclosure further provide a treadmill including a running deck assembly, the running deck assembly including: a front running deck; a rear running deck, wherein a front end face of the rear running deck abuts a rear end face of the front running deck; a flexible layer, laid on an upper surface of the front running deck and an upper surface of the rear running deck; and an annular running belt, rotatably mounted around the front running deck and the rear running deck with a clearance.

The running deck assembly according to the examples of the present disclosure is applied to the treadmill. When the treadmill is in use, the running deck assembly is unfolded, and the user may obtain a comfortable experience due to the soft layer 3 provided in the running deck assembly. When storing the treadmill up, the running deck assembly is folded, so as to reduce the occupied area and facilitate the storage.

Moreover, due to the spreading component 5 provided in the running deck assembly, the front and the rear running decks 1, 2 are flatly spread out. In such a way, the front and the rear running decks 1, 2 are flatly spread out, and thus do not affect the user experience on the annular running belt 4.

The soft layer 3 can be prevented from wear due to the wear-resisting layer 6 provided in the running deck assembly, and thus the service life of the soft layer 3 may be increased. The smooth layer 7 is laid on the upper surface of the wear-resisting layer 6, such that the sliding friction between the wear-resisting layer and the annular running belt 4 is reduced, thus the noise resulting from the friction during the transmission of the annular running belt 4 is prevented, and the annular running belt 4 can rotate more smoothly. This further improves the user experience of the treadmill.

As an example, the treadmill further includes the driving assembly configured to drive the running deck assembly, and a control assembly configured to control the driving assembly.

Specifically, the control assembly is configured to control a working state and the output power of the driving assembly or the like. The driving assembly is configured to transmit a driving force to the front roller 10 and/or the rear roller 11, such that the front roller 10 and/or the rear roller 11 bring the annular running belt 4 into motion.

In an example, the driving assembly may only provide the front roller 10 with the driving force and drive the front roller into rotation. The rear roller 11 may be driven by the front roller 10 under a cooperation of the front roller 10 and the annular running belt 4. This implementation not only facilitates the simplification of the structure of the treadmill with integration of the driving assembly and the control assembly in the front of the treadmill, but also is beneficial to reduce energy consumption.

In an example, the control assembly includes a controller, in which is provided a CPU (Central Processing Unit), to interpret and process the control instructions inputted into the controller by the user, and to send action instructions to the driving assembly, in order to control the driving assembly in operation.

In an example, the driving assembly includes a motor, which is transmissibly couple to the front roller 10 and is electrically connected to the controller. The controller controls the motor in operation. When the motor is in operation, it transmits the power to the front roller 10 and drives the front roller into rotation, thereby bringing annular running belt 4 into motion.

Upon studying the description and practicing the disclosure thereof, those skilled in the art will easily conceive other implementations of the examples of the present disclosure. The present disclosure is intended to cover any variation, use or adaptive modification of the examples of the present disclosure, which follow the general principles of the examples of the present disclosure and include the common knowledge or conventional technical means in the art not disclosed by the examples of the present disclosure.

It should be understood that the examples of the present disclosure is not limited to the specific structures described above and shown in drawings, and may be modified and changed without departing from the scope thereof.

The invention claimed is:

1. A running deck assembly, comprising:

a front running deck;

a rear running deck, wherein a front end face of the rear running deck directly abuts a rear end face of the front running deck;

a flexible layer in one-piece, laid on an upper surface of the front running deck and an upper surface of the rear running deck; and an annular running belt, rotatably mounted around the front running deck and the rear running deck with a clearance, wherein the flexible layer in one-piece is fixedly attached on the upper surface of the front running deck and the upper surface of the rear running deck, the flexible layer in one-piece is disposed between the annular running belt and upper surfaces of the front running deck and the rear running deck, and the rear running deck is folded up onto the front running deck by a flexibility property of the flexible layer in a folded state of the running deck assembly;

wherein the running deck assembly further comprises a detachable spreading component configured to keep the front running deck and the rear running deck flatly spread out;

wherein the detachable spreading component comprises: a first spreading board and at least two connecting bars provided on the first spreading board; wherein the at least two connecting bars are detachably connected to a lateral face of the front running deck and a lateral face of the rear running deck; and the first spreading board abuts the lateral face of the front running deck and the lateral face of the rear running deck.

2. The running deck assembly of claim 1, wherein the running deck assembly further comprises a wear-resisting layer;

wherein the wear-resisting layer is laid on an upper surface of the flexible layer.

3. The running deck assembly of claim 2, wherein the wear-resisting layer is laid on the upper surface of the flexible layer by adhering.

4. The running deck assembly of claim 2, wherein a material of the wear-resisting layer is one or a combination selected from a group consisting of: poly tetra fluoroethylene, polyamide, and polyethylene terephthalate.

5. The running deck assembly of claim 2, wherein the running deck assembly further comprises: a smoothing layer;

wherein the smoothing layer is laid on an upper surface of the wear-resisting layer.

6. The running deck assembly of claim 1, wherein:

the flexible layer is laid on the upper surface of the front running deck and the upper surface of the rear running deck by adhering; or the flexible layer is laid on the upper surface of the front running deck and the upper surface of the rear running deck by snap-fitting.

7. The running deck assembly of claim 1, wherein a material of the flexible layer is ethylene-vinyl acetate copolymer or polyethylene.

8. The running deck assembly of claim 1, wherein the rear running deck is foldable to the front running deck toward a direction of a lower surface of the flexible layer.

9. A treadmill, wherein the treadmill comprises a running deck assembly comprising:

a front running deck;

a rear running deck, wherein a front end face of the rear running deck directly abuts a rear end face of the front running deck;

a flexible layer in one-piece, laid on an upper surface of the front running deck and an upper surface of the rear running deck; and an annular running belt, rotatably mounted around the front running deck and the rear running deck with a clearance, wherein the flexible layer in one-piece is fixedly attached on the upper surface of the front running deck and the upper surface of the rear running deck, the flexible layer in one-piece is disposed between the annular running belt and upper surfaces of the front running deck and the rear running deck, and the rear running deck is folded up onto the front running deck by a flexibility property of the flexible layer in a folded state of the running deck assembly;

wherein the running deck assembly further comprises a detachable spreading component configured to keep the front running deck and the rear running deck flatly spread out;

wherein the detachable spreading component comprises: a first spreading board and at least two connecting bars provided on the first spreading board; wherein the at least two connecting bars are detachably connected to a lateral face of the front running deck and a lateral face of the rear running deck; and the first spreading board abuts the lateral face of the front running deck and the lateral face of the rear running deck.

10. The treadmill of claim 9, wherein the running deck assembly further comprises a wear-resisting layer;

wherein the wear-resisting layer is laid on an upper surface of the flexible layer.

11. The treadmill of claim 10, wherein the wear-resisting layer is laid on the upper surface of the flexible layer by adhering.

12. The treadmill of claim 10, wherein a material of the wear-resisting layer is one or a combination selected from a group consisting of: poly tetra fluoroethylene, polyamide, and polyethylene terephthalate.

13. The treadmill of claim 10, wherein the running deck assembly further comprises: a smoothing layer;

wherein the smoothing layer is laid on an upper surface of the wear-resisting layer.

14. The treadmill of claim 9, wherein:

the flexible layer is laid on the upper surface of the front running deck and the upper surface of the rear running deck by adhering; or the flexible layer is laid on the upper surface of the front running deck and the upper surface of the rear running deck by snap-fitting.

15. The treadmill of claim 9, wherein a material of the flexible layer is ethylene-vinyl acetate copolymer or polyethylene.

16. The treadmill of claim 9, wherein the rear running deck is foldable to the front running deck toward a direction of a lower surface of the flexible layer.

* * * * *